US011245193B2

(12) United States Patent
Kai

(10) Patent No.: US 11,245,193 B2
(45) Date of Patent: Feb. 8, 2022

(54) ANTENNA APPARATUS AND DESIGN PROGRAM FOR ANTENNA APPARATUS

(71) Applicant: FUJITSU LIMITED, Kawasaki (JP)

(72) Inventor: Manabu Kai, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 74 days.

(21) Appl. No.: 16/223,059

(22) Filed: Dec. 17, 2018

(65) Prior Publication Data

US 2019/0190121 A1 Jun. 20, 2019

(30) Foreign Application Priority Data

Dec. 20, 2017 (JP) ..... JP2017-243870

(51) Int. Cl.

| | |
|---|---|
| ***H01Q 1/24*** | (2006.01) |
| ***H01Q 9/04*** | (2006.01) |
| ***H01Q 9/42*** | (2006.01) |
| ***H01Q 1/22*** | (2006.01) |
| ***H01Q 5/328*** | (2015.01) |
| ***H01Q 5/378*** | (2015.01) |

(52) U.S. Cl.

CPC ..... *H01Q 9/42* (2013.01); *H01Q 1/2291* (2013.01); *H01Q 1/243* (2013.01); *H01Q 5/328* (2015.01); *H01Q 5/378* (2015.01); *H01Q 9/0421* (2013.01)

(58) Field of Classification Search

CPC ..... H01Q 1/24; H01Q 1/243; H01Q 1/2291; H01Q 1/48; H01Q 1/52; H01Q 9/0421; H01Q 9/0442; H01Q 9/42; H01Q 1/526; H01Q 1/528; H01Q 5/30; H01Q 5/328; H01Q 5/378; H01Q 5/385; H01Q 5/392

See application file for complete search history.

(56) References Cited

U.S. PATENT DOCUMENTS

| | | | | |
|---|---|---|---|---|
| 10,749,247 | B2 * | 8/2020 | Tornatta, Jr. ..... | H01Q 5/30 |
| 2007/0229366 | A1 * | 10/2007 | Kim ..... | H01Q 1/243 343/700 MS |
| 2010/0052992 | A1 | 3/2010 | Okamura et al. | |
| 2013/0076574 | A1 * | 3/2013 | Rappoport ..... | H01Q 1/243 343/702 |

(Continued)

FOREIGN PATENT DOCUMENTS

| | | |
|---|---|---|
| JP | 2005-20266 | 1/2005 |
| JP | 2007-143132 | 6/2007 |

(Continued)

OTHER PUBLICATIONS

JPOA—Japanese Office Action dated Jun. 29, 2021 for corresponding Japanese Patent Application No. 2017-243870 with Machine Translation.

*Primary Examiner* — Robert Karacsony
(74) *Attorney, Agent, or Firm* — Fujitsu Patent Center

(57) ABSTRACT

An antenna apparatus includes a ground conductor, an antenna element including an antenna that is parallel to the ground conductor and that has a first end portion and a second end portion, a feed line that is coupled to the first end portion of the antenna and that feeds the antenna through the ground conductor, and a short-circuit line that is coupled to the first end portion of the antenna and that electrically short-circuits the antenna to the ground conductor, and a dummy conductor mounted between the first end portion or the second end portion of the antenna and the ground conductor.

4 Claims, 15 Drawing Sheets

(56) References Cited

U.S. PATENT DOCUMENTS

| | | | | |
|---|---|---|---|---|
| 2013/0314285 | A1 | 11/2013 | Takasaki | |
| 2014/0292587 | A1* | 10/2014 | Yarga | H01Q 5/378<br>343/702 |
| 2017/0110786 | A1* | 4/2017 | Liu | H01Q 5/378 |

FOREIGN PATENT DOCUMENTS

| | | |
|---|---|---|
| JP | 2011-30162 | 2/2011 |
| JP | 2011-155531 | 8/2011 |
| JP | 2013-247526 | 12/2013 |

* cited by examiner

ANTENNA APPARATUS AND DESIGN PROGRAM FOR ANTENNA APPARATUS

CROSS-REFERENCE TO RELATED APPLICATION

This application is based upon and claims the benefit of priority of the prior Japanese Patent Application No. 2017-243870, filed on Dec. 20, 2017, the entire contents of which are incorporated herein by reference.

FIELD

The embodiment discussed herein is related to an antenna apparatus and design program for an antenna apparatus.

BACKGROUND

There is widespread use of wireless communication devices such as the Internet of Things (IoT) sensors, which are used for IoT-related business. A wireless communication device includes an antenna apparatus for transmitting and receiving a wireless signal. For example, inverted-L or inverted-F antennas are used in antenna apparatuses for downsizing wireless communication devices and reducing cost. An inverted-L antenna is a linear antenna made of a lead wire whose total length, which is the sum of lengths in the vertical and horizontal directions, is equal to a quarter of the wavelength. An inverted-F antenna is realized by adding a short-circuit line to an inverted-L antenna.

Various techniques have been disclosed with regard to an antenna apparatus in which a floating conductor pattern formed near an antenna enables an inverted-F antenna to deal with wide and multiple bandwidths.

Since antenna forms have become complex, obtaining accurate antenna characteristics with the effect of a conductor pattern near an antenna taken into account requires a simulator to analyze electromagnetic fields in and around an antenna apparatus. Suppliers of antenna apparatuses evaluate antenna characteristics under ideal conditions where no obstacle is present near an antenna and then place their products on the market.

However, when a manufacturer of wireless communication devices mounts an antenna apparatus purchased from a supplier in a wireless communication device and provides a user with such a wireless communication device, the antenna apparatus sometimes fails to operate as expected in the wireless communication device in accordance with the antenna characteristics provided by the supplier. Such a failure is due to a change in the antenna characteristics caused by the surrounding environment in which the wireless communication device is installed.

The followings are reference documents.

[Document 1] Japanese Laid-open Patent Publication No. 2005-020266,

[Document 2] Japanese Laid-open Patent Publication No. 2007-143132, and

[Document 3] Japanese Laid-open Patent Publication No. 2013-247526.

SUMMARY

According to an aspect of the embodiments, an antenna apparatus includes a ground conductor, an antenna element including an antenna that is parallel to the ground conductor and that has a first end portion and a second end portion, a feed line that is coupled to the first end portion of the antenna and that feeds the antenna through the ground conductor, and a short-circuit line that is coupled to the first end portion of the antenna and that electrically short-circuits the antenna to the ground conductor, and a dummy conductor mounted between the first end portion or the second end portion of the antenna and the ground conductor.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Figure 1C:
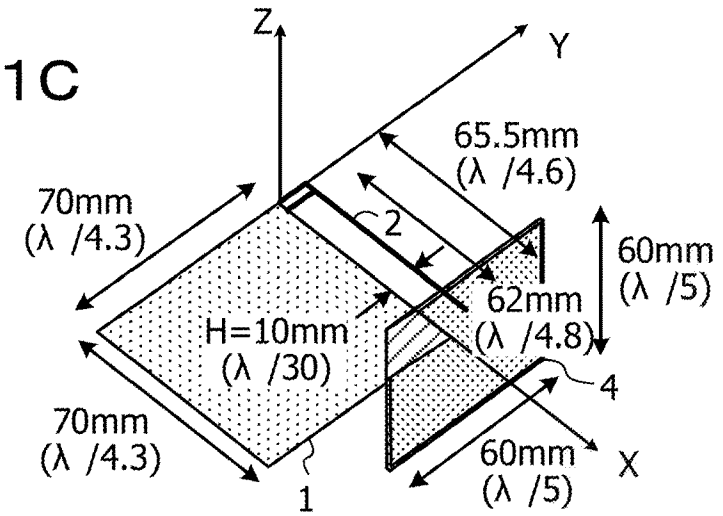
FIGS. 1A-1D depict arrangements of an antenna apparatus and an external conductor.
Figure 1D:
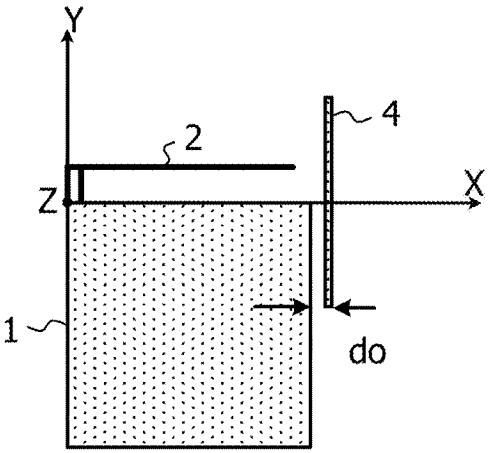
Figure 1A:
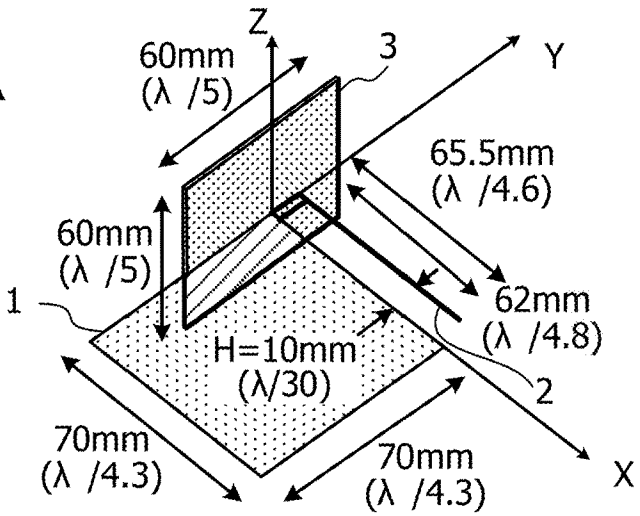
Figure 1B:
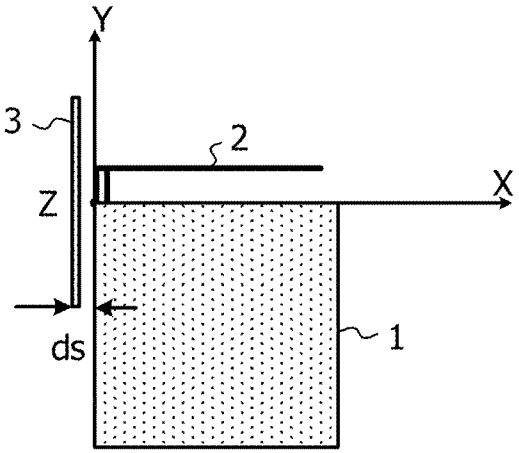

FIGS. 1A-1D depict arrangements of an antenna apparatus and an external conductor. FIG. 1A depicts an external conductor 3 arranged near the feed-point side of an antenna element 2. FIG. 1B is a view of the arrangement in FIG. 1A projected onto the XY plane. FIG. 1C depicts an external conductor 4 arranged on the open-end side of the antenna element 2. FIG. 1D is a view of the arrangement in FIG. 1C projected onto the XY plane. FIGS. 1A-1D, which depict arrangements of components, represent, for example, operation screens of a three-dimensional computer-aided design (CAD) application for developing a model for analysis in an antenna designing apparatus for calculating antenna characteristics of an antenna apparatus.

FIGS. 1A and 1B depict the arrangement of a ground conductor 1, the antenna element 2, and the external conductor 3. The ground conductor 1 is a grounded conductor being a reference plane for a voltage fed into the antenna element 2. The antenna element 2 has an antenna, a feed line, and a short-circuit line. The antenna extends in a longitudinal direction, which is parallel to the ground conductor 1. One end of the antenna is called a first end portion, and the other end is called a second end portion. The ground conductor 1 and the antenna are connected to the feed line that is located on the Y-axis and that has a feed point so that one side of the ground conductor 1 and the antenna are perpendicular to the feed line. In addition, the ground conductor 1 and the antenna are connected to the short-circuit line that is located near the connecting line on the Y-axis so that one side of the ground conductor 1 and the antenna are perpendicular to the short-circuit line. In this embodiment, the antenna element 2 constitutes an inverted-F antenna.

As depicted in FIGS. 1A and 1B, the ground conductor 1 is placed on the XY plane. The ground conductor 1 is square and measures 70 mm in the X-axis direction and 70 mm in the Y-axis direction. The symbol λ in FIG. 1A denotes the wavelength at the resonance of the antenna element 2. In the antenna element 2, the antenna is placed parallel to the X-axis and separated from the X-axis by 10 mm in the Y-axis direction. The antenna is 65.5 mm in length from the feed point to the opposite end of the antenna from the feed point and 62 mm in length from the connecting point of the short-circuit line to the opposite end of the antenna from the feed point. The external conductor 3 is placed parallel to the YZ plane. The external conductor 3 is square and measures 60 mm in the Y-axis direction and 60 mm in the Z-axis direction. The external conductor 3 is placed perpendicularly to the antenna of the antenna element 2. The center of gravity of the external conductor 3 is placed on the X-axis. The external conductor 3 is placed on the feed-point side of the antenna element 2. The external conductor 3 is separated from the YZ plane by a distance ds.

FIGS. 1C and 1D depict an arrangement of the ground conductor 1, the antenna element 2, and the external conductor 4. The ground conductor 1 is a reference plane for a voltage fed into the antenna element 2. The ground conductor 1 and the antenna element 2 are connected to each other via a connecting line that is located on the Y-axis and that has a feed point. In addition, the antenna element 2 is short-circuited to the ground conductor 1 via a connecting line located near the connecting line on the Y-axis. In this embodiment, the antenna element 2 constitutes an inverted-F antenna.

As depicted in FIGS. 1C and 1D, the ground conductor 1 is placed on the XY plane. The ground conductor 1 is square and measures 70 mm in the X-axis direction and 70 mm in the Y-axis direction. The symbol λ in FIG. 1C denotes the wavelength at the resonance of the antenna element 2. In the antenna element 2, the antenna is placed parallel to the X-axis and separated from the X-axis by 10 mm in the Y-axis direction. The antenna is 65.5 mm in length from the feed point to the opposite end of the antenna from the feed point and 62 mm in length from the connecting point of the short-circuit line to the opposite end of the antenna from the feed point. The external conductor 4 is placed parallel to the YZ plane. The external conductor 4 is square and measures 60 mm in the Y-axis direction and 60 mm in the Z-axis direction. The external conductor 4 is placed perpendicularly to the antenna of the antenna element 2. The center of gravity of the external conductor 4 is placed on the X-axis. The external conductor 4 is placed on the open-end side of the antenna element 2. The external conductor 4 is separated from the YZ plane by a distance do.

Figure 2:
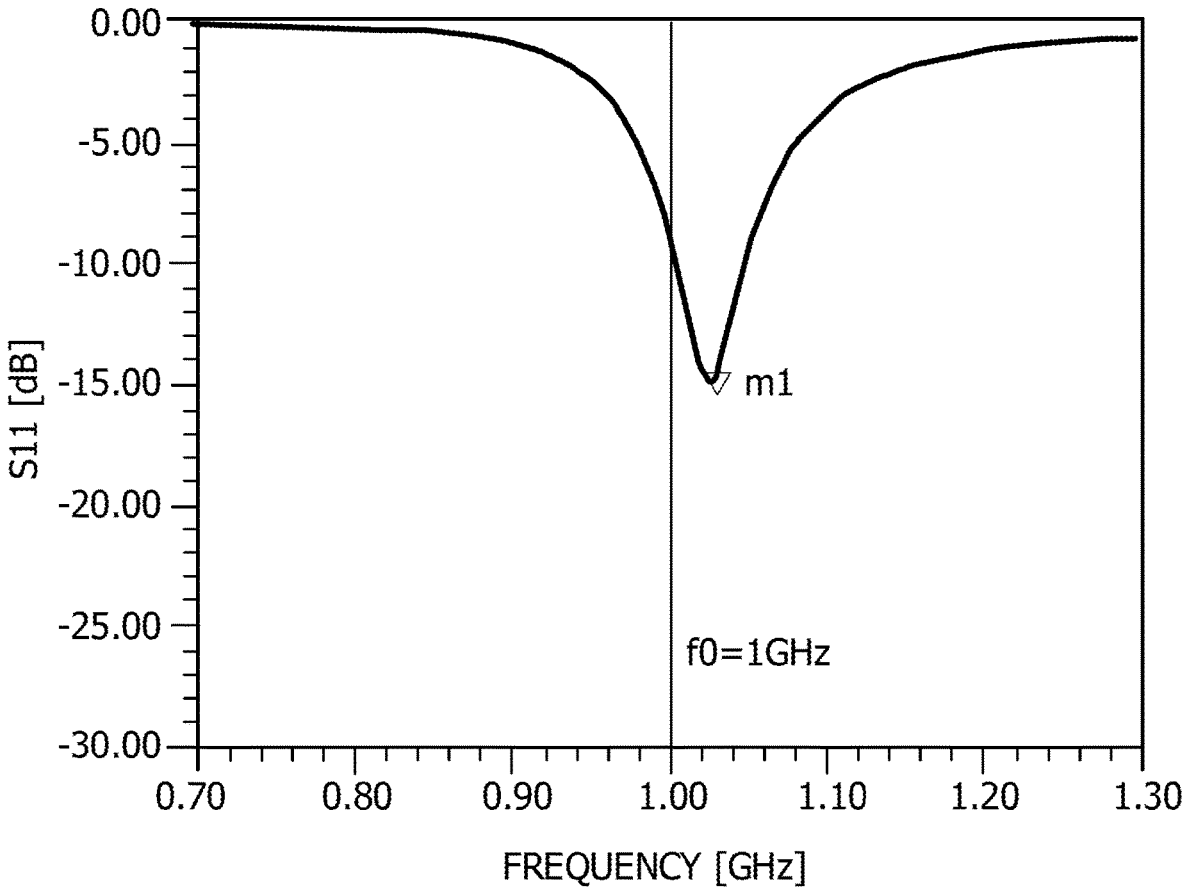
FIG. 2 depicts the effect of an external conductor on antenna characteristics.

FIG. 2 depicts the effect of an external conductor on antenna characteristics. The graph in FIG. 2 illustrates characteristics of parameter S11 of the S parameters of the antenna element 2 calculated from the feed-point side.

In the graph in FIG. 2, the horizontal axis represents the frequency of the signal that is input from the feed point to the antenna element 2, and the vertical axis represents the magnitude of parameter S11, which represents a reflection loss, of the S parameters of the antenna element 2. As S11 decreases, the reflection loss of the antenna element 2 decreases.

In this embodiment, the antenna element 2 is designed so that S11 is minimum at 1 GHz in the case where no external conductor that affects the antenna characteristics is present in the surrounding area. The graph in FIG. 2 indicates S11 characteristics of the antenna element 2 in the case where ds=1 mm (ds/λ=0.003) in FIG. 1B. In FIG. 2, the marker m1 that denotes the minimum value of S11 is located at a frequency higher than 1 GHz at which the minimum is located at design time. FIG. 2 indicates that the antenna characteristics of the antenna element 2 change due to the effect of a conductor placed in the surrounding area. Referring to FIG. 2, the reflection loss increases as demonstrated by the S11 change from −15 dB, which is the value of S11 at a frequency of 1 GHz at design time, to −8 dB due to the effect of a conductor, and this increase in the reflection loss causes the wireless signal quality to deteriorate and power consumption to increase during operation of a wireless communication device in real-world situations.

Figure 3:
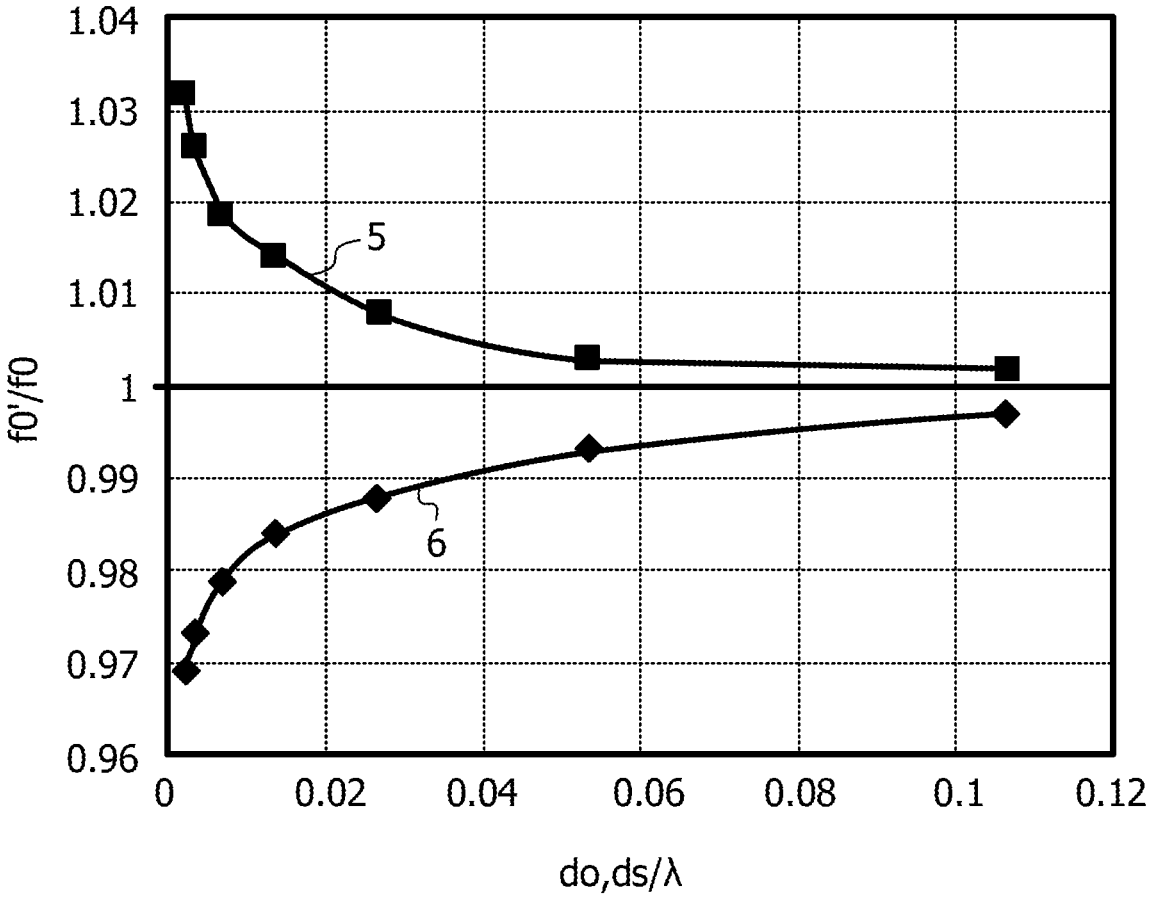
FIG. 3 depicts changes in the antenna characteristics with respect to the distance between an antenna apparatus and an external conductor.

FIG. 3 depicts changes in the antenna characteristics with respect to the distance between the antenna apparatus and an external conductor. In the graph in FIG. 3, the horizontal axis represents the ratio of the distance between the antenna element 2 and an external conductor to the wavelength λ at the resonance frequency f0 of the antenna element 2, where the distances are denoted by ds as in FIG. 1B and do as in FIG. 1D. The vertical axis represents the ratio of the resonance frequency f0' of the antenna element 2 affected by an external conductor to the resonance frequency f0 of the antenna element 2 that is not affected by an external conductor.

In FIG. 3, curve 5 represents the change in the resonance frequency f0' of the antenna element 2 with respect to ds depicted in FIG. 1B. As demonstrated by curve 5, when the external conductor 3 is present on the feed-point side of the antenna element 2, the resonance frequency f0' of the antenna element 2 increases as the distance between the antenna element 2 and the external conductor 3 decreases.

In FIG. 3, curve 6 represents the change in the resonance frequency f0' of the antenna element 2 with respect to do depicted in FIG. 1D. As demonstrated by curve 6, when the external conductor 4 is present on the open-end side of the antenna element 2, the resonance frequency f0' of the antenna element 2 decreases as the distance between the antenna element 2 and the external conductor 4 decreases.

Figure 4A:
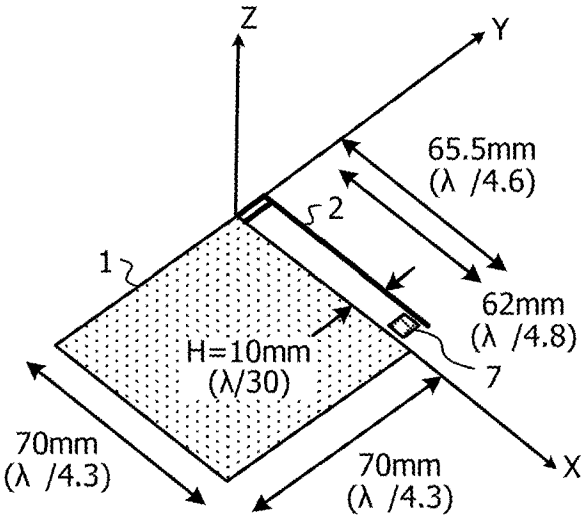
FIGS. 4A-4D depict arrangements of an antenna apparatus when a dummy conductor is added.
Figure 4B:
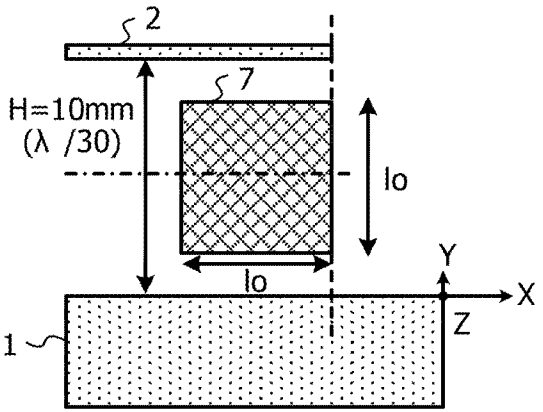
Figure 4C:
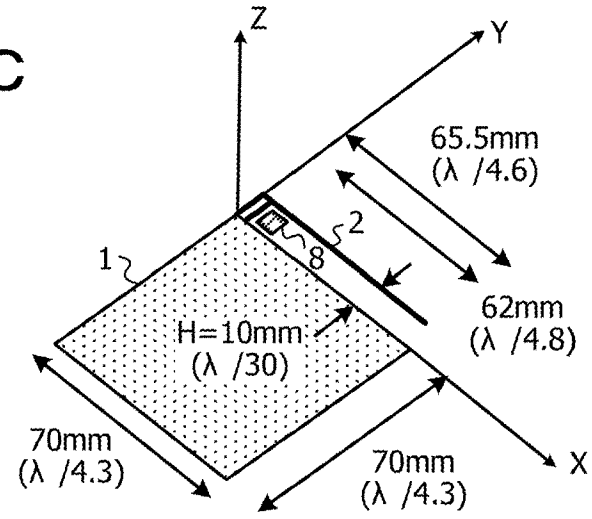
Figure 4D:
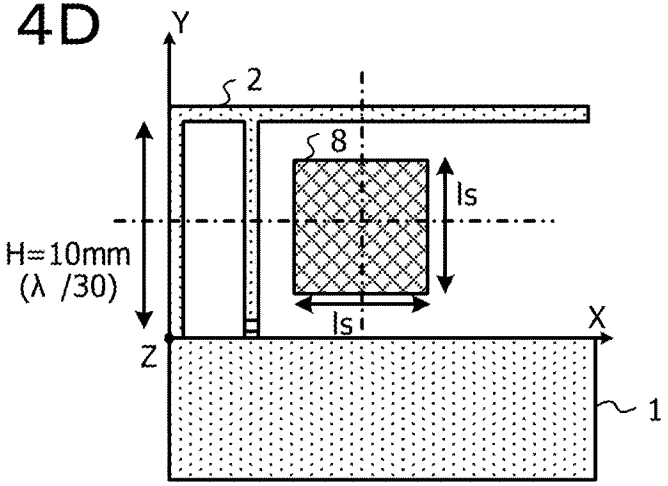

FIGS. 4A-4D depict arrangements of an antenna apparatus when a dummy conductor is added. FIG. 4A depicts a dummy conductor 7 arranged near the open end of the antenna element 2. FIG. 4B is a view of the arrangement in FIG. 4A projected onto the XY plane. FIG. 4C depicts a dummy conductor 8 arranged on the feed-point side of the antenna element 2. FIG. 4D is a view of the arrangement in FIG. 4C projected onto the XY plane. FIGS. 4A-4D, which depict arrangements of components, represent, for example, operation screens of a three-dimensional CAD application for developing a model for analysis in a simulator for calculating antenna characteristics of an antenna apparatus.

FIGS. 4A and 4B depict an arrangement of the ground conductor 1, the antenna element 2, and the dummy conductor 7. The ground conductor 1 is a reference plane for a voltage fed into the antenna element 2. The ground conductor 1 and the antenna element 2 are connected to each other via a connecting line that is located on the Y-axis and that has a feed point. In addition, the antenna element 2 is short-circuited to the ground conductor 1 via a connecting line located near the connecting line on the Y-axis. In this embodiment, the antenna element 2 constitutes an inverted-F antenna.

As depicted in FIGS. 4A and 4B, the ground conductor 1 is placed on the XY plane. The ground conductor 1 is square and measures 70 mm in the X-axis direction and 70 mm in the Y-axis direction. The symbol λ in FIGS. 4A and 4B denotes the wavelength at the resonance of the antenna element 2. In the antenna element 2, the antenna is placed parallel to the X-axis and separated from the X-axis by 10 mm in the Y-axis direction. The antenna is 65.5 mm in length from the feed point to the opposite end of the antenna from the feed point and 62 mm in length from the connecting point of the short-circuit line to the opposite end of the antenna from the feed point. The dummy conductor 7 is placed parallel to the XY plane. The dummy conductor 7 is square with both of the side lengths in the X-axis direction and in the Y-axis direction being equal to lo. The center of gravity of the dummy conductor 7 is located on a line equidistant from the X-axis and from the antenna element 2. The dummy conductor 7 is placed on the open-end side of the antenna element 2. In this embodiment, the dummy conductor 7 is square but may be another shape such as a rectangle or a circle.

FIGS. 4C and 4D depict an arrangement of the ground conductor 1, the antenna element 2, and the dummy conductor 8. The ground conductor 1 is a reference plane for a voltage fed into the antenna element 2. The ground conductor 1 and the antenna element 2 are connected to each other via a connecting line that is located on the Y-axis and that has a feed point. In addition, the antenna element 2 is short-circuited to the ground conductor 1 via a connecting line located near the connecting line on the Y-axis. In this embodiment, the antenna element 2 constitutes an inverted-F antenna.

As depicted in FIGS. 4C and 4D, the ground conductor 1 is placed on the XY plane. The ground conductor 1 is square and measures 70 mm in the X-axis direction and 70 mm in the Y-axis direction. The symbol λ in FIGS. 4C and 4D denotes the wavelength at the resonance of the antenna element 2. In the antenna element 2, the antenna is placed parallel to the X-axis and separated from the X-axis by 10 mm in the Y-axis direction. The antenna is 65.5 mm in length from the feed point to the opposite end of the antenna from the feed point and 62 mm in length from the connecting point of the short-circuit line to the opposite end of the antenna from the feed point. The dummy conductor 8 is placed parallel to the XY plane. The dummy conductor 8 is square with both of the side lengths in the X-axis direction and in the Y-axis direction being equal to ls. The center of gravity of the dummy conductor 8 is located on a line equidistant from the X-axis and from the antenna element 2. The dummy conductor 8 is placed on the feed-point side of the antenna element 2. In this embodiment, the dummy conductor 8 is square but may be another shape such as a rectangle or a circle.

Figure 5:
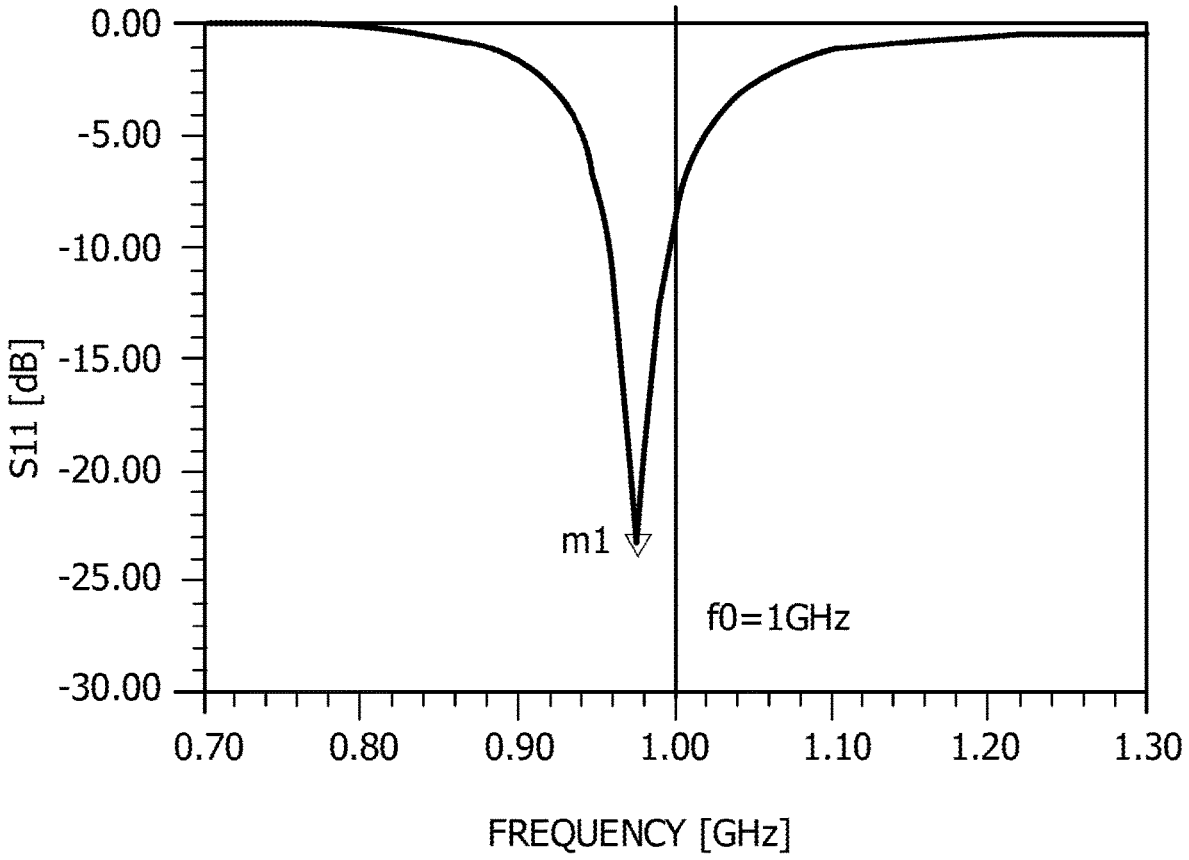
FIG. 5 depicts the effect of a dummy conductor on antenna characteristics.

FIG. 5 depicts the effect of a dummy conductor on antenna characteristics. The graph in FIG. 5 illustrates characteristics of parameter S11 of the S parameters of the antenna element 2 calculated from the feed-point side.

In the graph in FIG. 5, the horizontal axis represents the frequency of the signal that is input from the feed point to the antenna element 2, and the vertical axis represents the magnitude of parameter S11, which represents a reflection loss, of the S parameters of the antenna element 2. As S11 decreases, the reflection loss of the antenna element 2 decreases.

In this embodiment, the antenna element 2 is designed so that S11 is minimum at 1 GHz in the case where no external conductor that affects the antenna characteristics is present in the surrounding area. The graph in FIG. 5 indicates S11 characteristics of the antenna element 2 in the case where lo=8 mm (lo/λ, =0.027) in FIG. 4B. In FIG. 5, the marker m1 that denotes the minimum value of S11 is located at a frequency lower than 1 GHz at which the minimum is located at design time. FIG. 5 indicates that the antenna characteristics of the antenna element 2 change due to the effect of the dummy conductor 7.

A comparison between the change in the resonance frequency demonstrated by the graph in FIG. 5 and the change in the resonance frequency demonstrated by the graph in FIG. 2 indicates that the resonance frequency changes in opposite directions due to the effect of an external conductor and due to the effect of a dummy conductor. If a dummy conductor is added so as to nullify the change in the resonance frequency due to an external conductor, it is possible to operate the antenna element 2 at the resonance frequency as designed irrespective of the presence of an external conductor.

Figure 6:
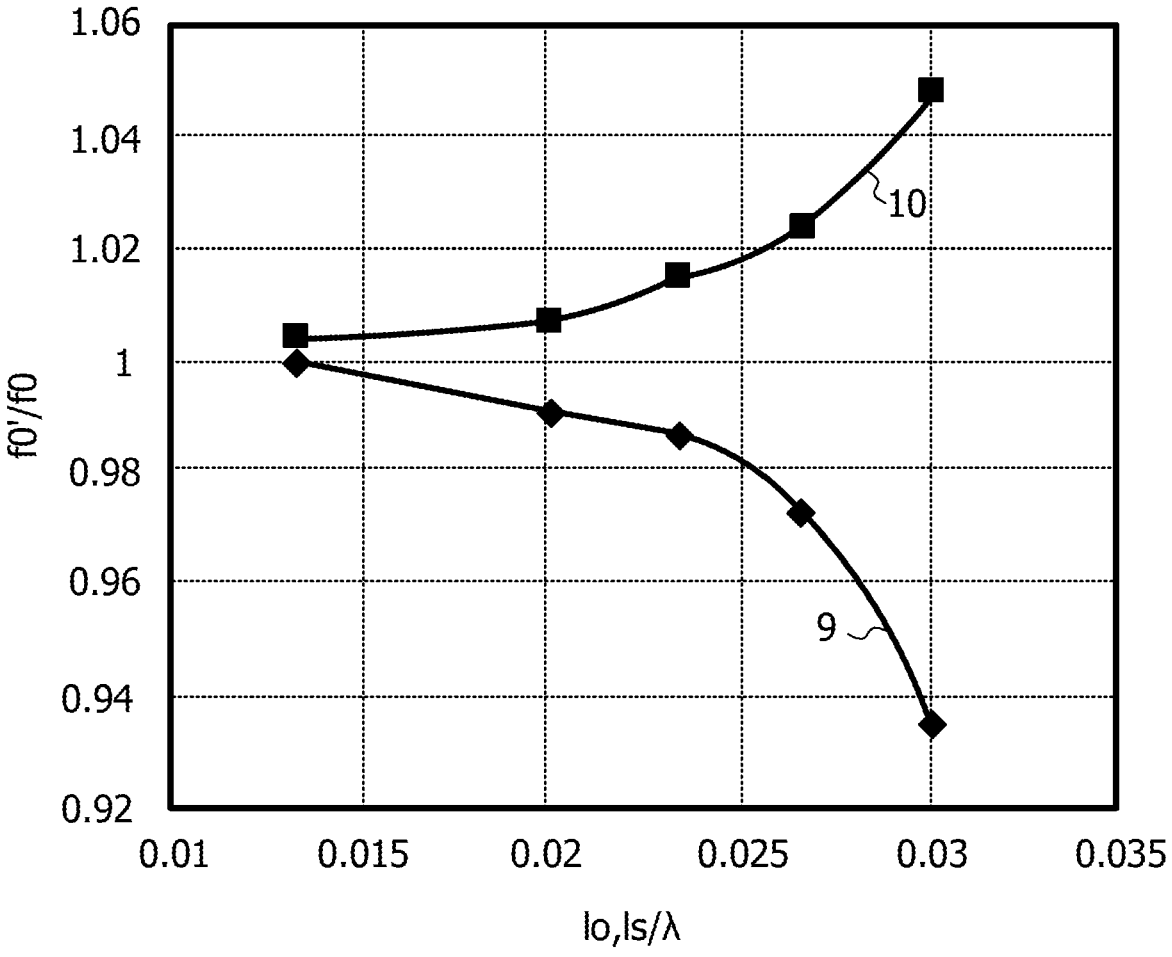
FIG. 6 depicts changes in the antenna characteristics with respect to the side length of a dummy conductor.

FIG. 6 depicts changes in the antenna characteristics with respect to the side length of a dummy conductor. In the graph in FIG. 6, the horizontal axis represents the ratio of the side length of a dummy conductor to the wavelength λ at the resonance frequency f0 of the antenna element 2, where the side lengths are denoted by lo as in FIG. 4B and ls as in FIG. 4D. The vertical axis represents the ratio of the resonance frequency f0' of the antenna element 2 affected by an external conductor to the resonance frequency f0 of the antenna element 2 that is not affected by an external conductor.

In FIG. 6, curve 9 represents the change in the resonance frequency f0' of the antenna element 2 with respect to lo of the dummy conductor 7 depicted in FIG. 4B. As demonstrated by curve 9, when the dummy conductor 7 is present on the open-end side of the antenna element 2, the resonance frequency f0' of the antenna element 2 decreases as the side length of the dummy conductor 7 increases.

In FIG. 6, curve 10 represents the change in the resonance frequency f0' of the antenna element 2 with respect to ls of the dummy conductor 8 depicted in FIG. 4D. As demonstrated by curve 10, when the dummy conductor 8 is present on the feed-point side of the antenna element 2, the resonance frequency f0' of the antenna element 2 increases as the side length of the dummy conductor 8 increases.

Thus, if a condition of adding a dummy conductor is set so as to nullify the change in the resonance frequency due to an external conductor in accordance with the graph in FIG. 6, it is possible to operate the antenna element 2 at the resonance frequency as designed irrespective of the presence of an external conductor.

Figure 7:
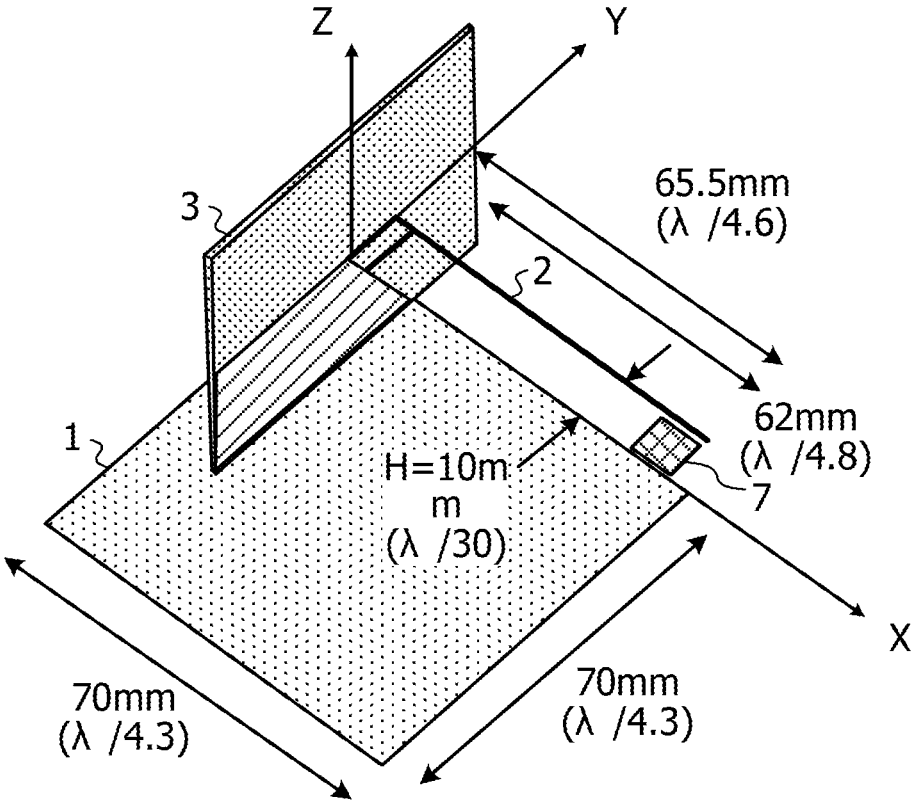
FIG. 7 depicts an arrangement of an antenna apparatus, an external conductor, and a dummy conductor.

FIG. 7 depicts an arrangement of an antenna apparatus, an external conductor, and a dummy conductor. In FIG. 7, the external conductor 3 is placed on the feed-point side of the antenna element 2. The dummy conductor 7 is placed on the open-end side of the antenna element 2. The same elements in FIG. 7 as in FIG. 1A are denoted by the same reference numerals and are not repeatedly described herein. FIG. 7, which depicts an arrangement of components, represents, for example, an operation screen of a three-dimensional CAD application for developing a model for analysis in a simulator for calculating antenna characteristics of the antenna element 2.

As described above, when the external conductor 3 is present on the feed-point side of the antenna element 2, the resonance frequency of the antenna element 2 becomes higher than the designed value. In contrast, when the dummy conductor 7 is present on the open-end side of the antenna element 2, the resonance frequency of the antenna element 2 becomes lower than the designed value. Thus, if the dummy conductor 7 is mounted so as to nullify the amount of shift in the resonance frequency of the antenna element 2 due to the external conductor 3, it is possible to adjust the resonance frequency of the antenna element 2 to the designed value.

Figure 8:
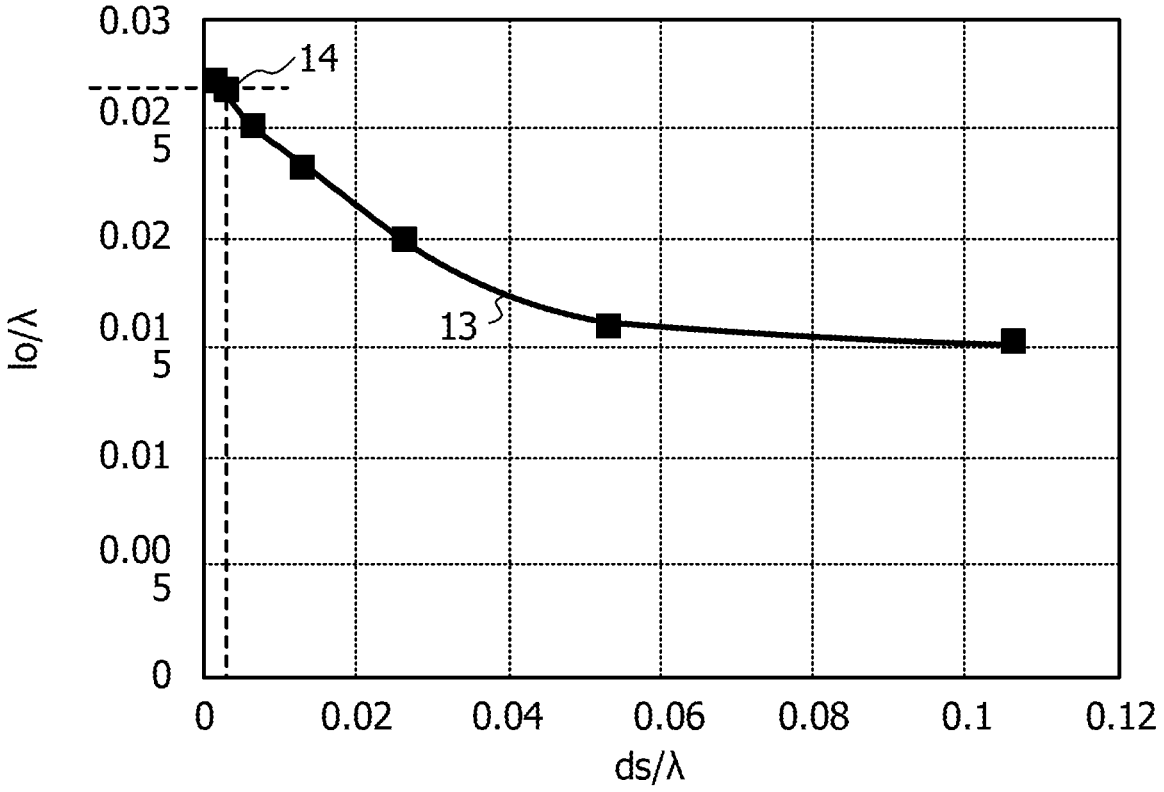
FIG. 8 depicts a relation between mounting conditions of an external conductor and a dummy conductor.

FIG. 8 depicts a relation between mounting conditions of an external conductor and a dummy conductor. In FIG. 8, the horizontal axis represents the distance ds between the external conductor 3 and the antenna element 2. The symbol λ in FIG. 8 denotes the wavelength at the designed resonance frequency of the antenna element 2, which is 1 GHz. The vertical axis represents the side length lo of the dummy conductor 7. Curve 13 in FIG. 8 represents a relation between the distance ds and the side length lo, and the relation is required for mounting the dummy conductor 7 so as to nullify the change in the resonance frequency of the antenna element 2 due to the placement of the external conductor 3.

For example, if the external conductor 3 is mounted at a distance ds of 1 mm (ds/λ=0.003), the side length lo of the dummy conductor 7 required to nullify the effect of the external conductor 3 is 8 mm (lo/λ=0.027) in accordance with point 14 on curve 13. If the dummy conductor 7 having this side length lo is mounted, it is possible to operate the antenna element 2 as designed.

Figure 9:
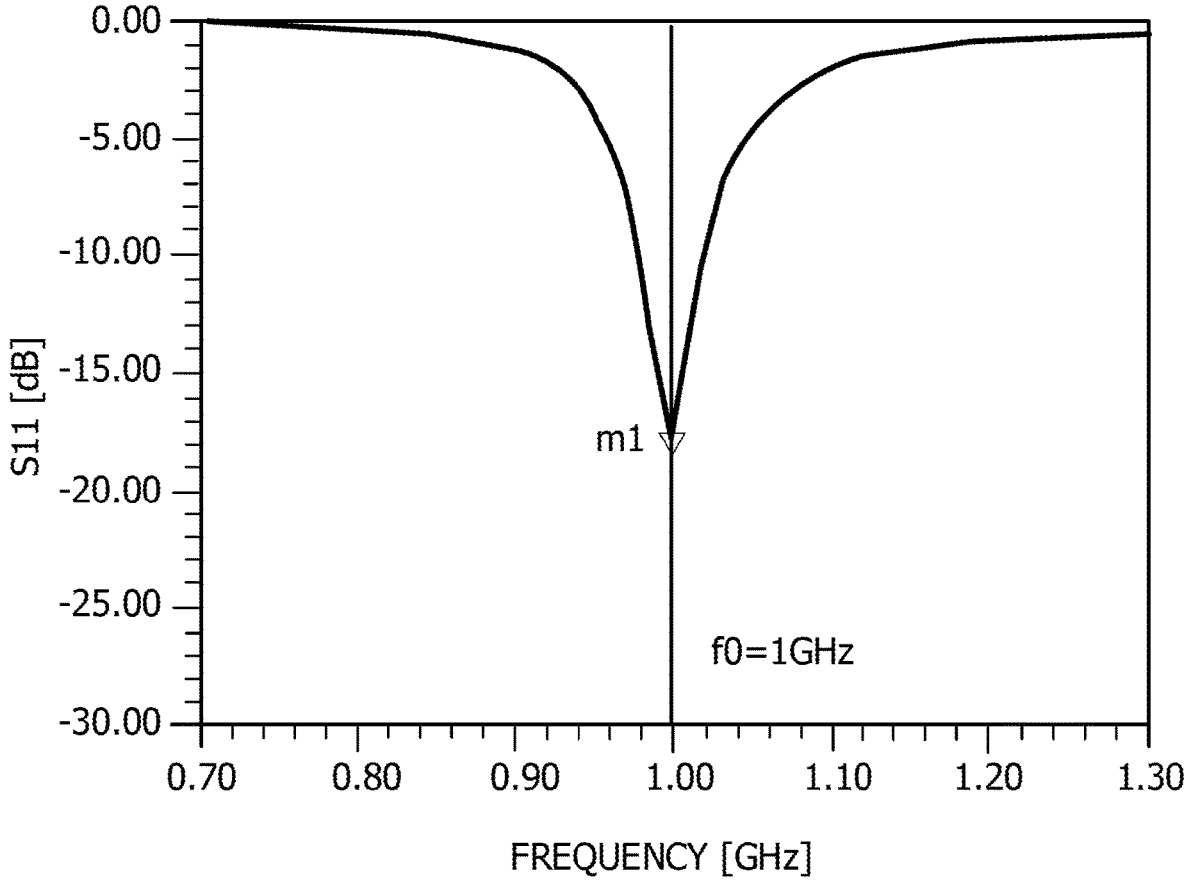
FIG. 9 depicts reflection characteristics of an antenna apparatus obtained when an external conductor and a dummy conductor are mounted.

FIG. 9 depicts reflection characteristics of an antenna apparatus obtained when an external conductor and a dummy conductor are mounted. If the dummy conductor 7 is mounted so as to nullify the amount of shift in the resonance frequency of the antenna element 2 due to the external conductor 3 in accordance with curve 13 in FIG. 8, it is possible to adjust the resonance frequency of the antenna element 2 to the designed resonance frequency f0 equal to 1 GHz, as depicted in FIG. 9.

Figure 10:
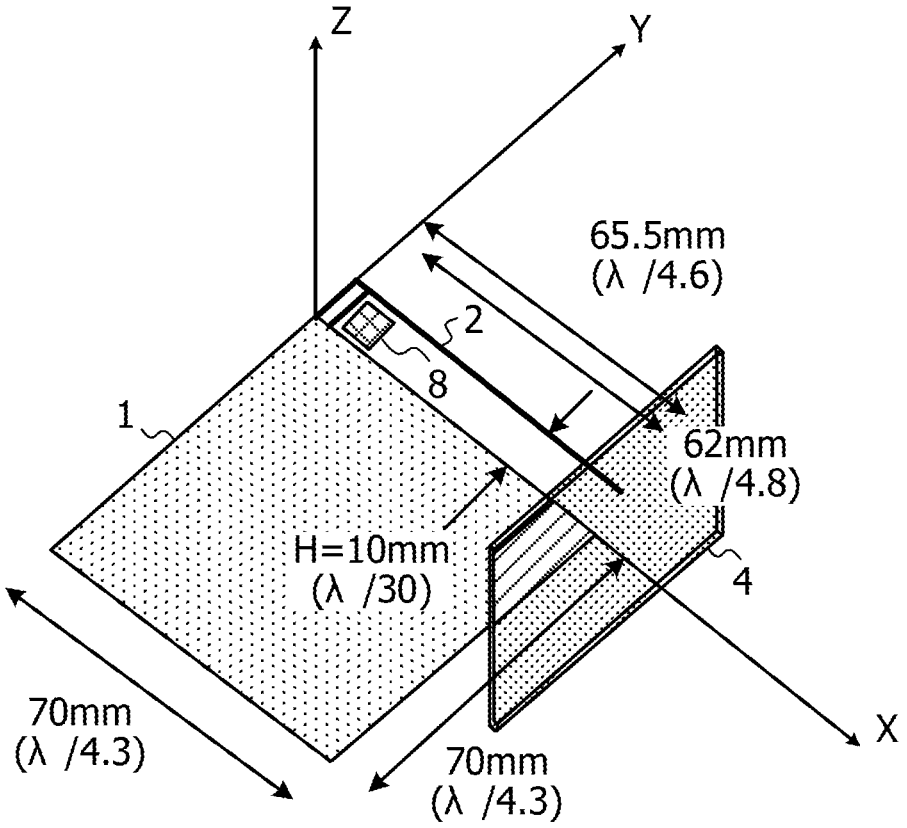
FIG. 10 depicts another arrangement of an antenna apparatus, an external conductor, and a dummy conductor.

FIG. 10 depicts another arrangement of an antenna apparatus, an external conductor, and a dummy conductor. In FIG. 10, the external conductor 4 is placed on the open-end side of the antenna element 2. The dummy conductor 8 is placed on the feed-point side of the antenna element 2. The same elements in FIG. 10 as in FIG. 1C are denoted by the same reference numerals and are not repeatedly described herein. FIG. 10, which depicts an arrangement of components, represents, for example, an operation screen of a three-dimensional CAD application for developing a model for analysis in a simulator for calculating antenna characteristics of the antenna element 2.

As described above, when the external conductor 4 is present on the open-end side of the antenna element 2, the resonance frequency of the antenna element 2 becomes lower than the designed value. In contrast, when the dummy conductor 8 is present on the feed-point side of the antenna element 2, the resonance frequency of the antenna element 2 becomes higher than the designed value. Thus, if the dummy conductor 8 is mounted so as to nullify the effect of the external conductor 4 on the resonance frequency of the antenna element 2, it is possible to adjust the resonance frequency of the antenna element 2 to the designed value.

Figure 11:
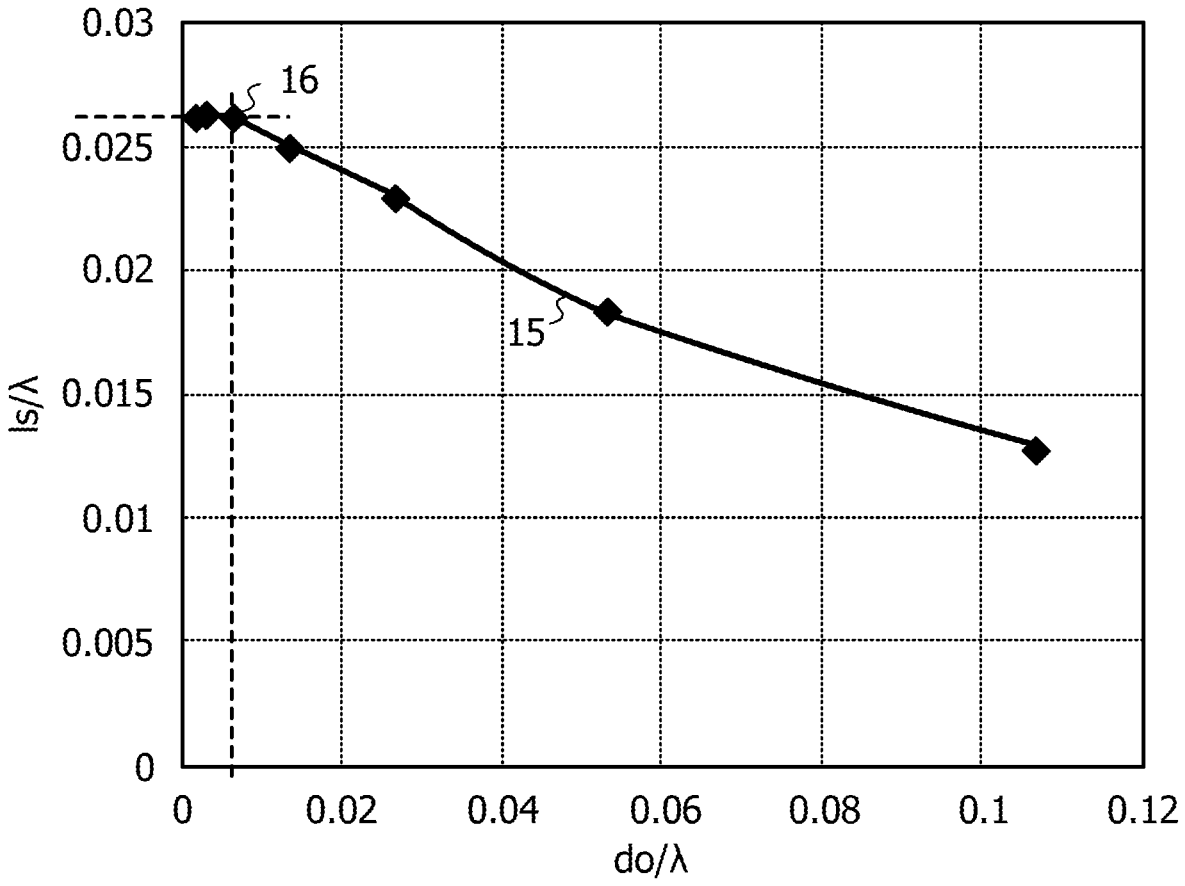
FIG. 11 depicts another relation between mounting conditions of an external conductor and a dummy conductor.

FIG. 11 depicts another relation between mounting conditions of an external conductor and a dummy conductor. In FIG. 11, the horizontal axis represents the distance do between the external conductor 4 and the antenna element 2. The symbol λ in FIG. 11 denotes the wavelength at the designed resonance frequency of the antenna element 2, which is 1 GHz. The vertical axis represents the side length ls of the dummy conductor 8. Curve 15 in FIG. 11 represents a relation between the distance do and the side length ls, and the relation is required for mounting the dummy conductor 8 so as to nullify the change in the resonance frequency of the antenna element 2 due to the placement of the external conductor 4.

For example, if the external conductor 4 is mounted at a distance do of 2 mm (do/λ=0.007), the side length ls of the dummy conductor 8 required to nullify the effect of the external conductor 4 is 8 mm (ls/λ=0.027) in accordance with point 16 on curve 15. If the dummy conductor 8 having this side length ls is mounted, it is possible to operate the antenna element 2 as designed.

Figure 12:
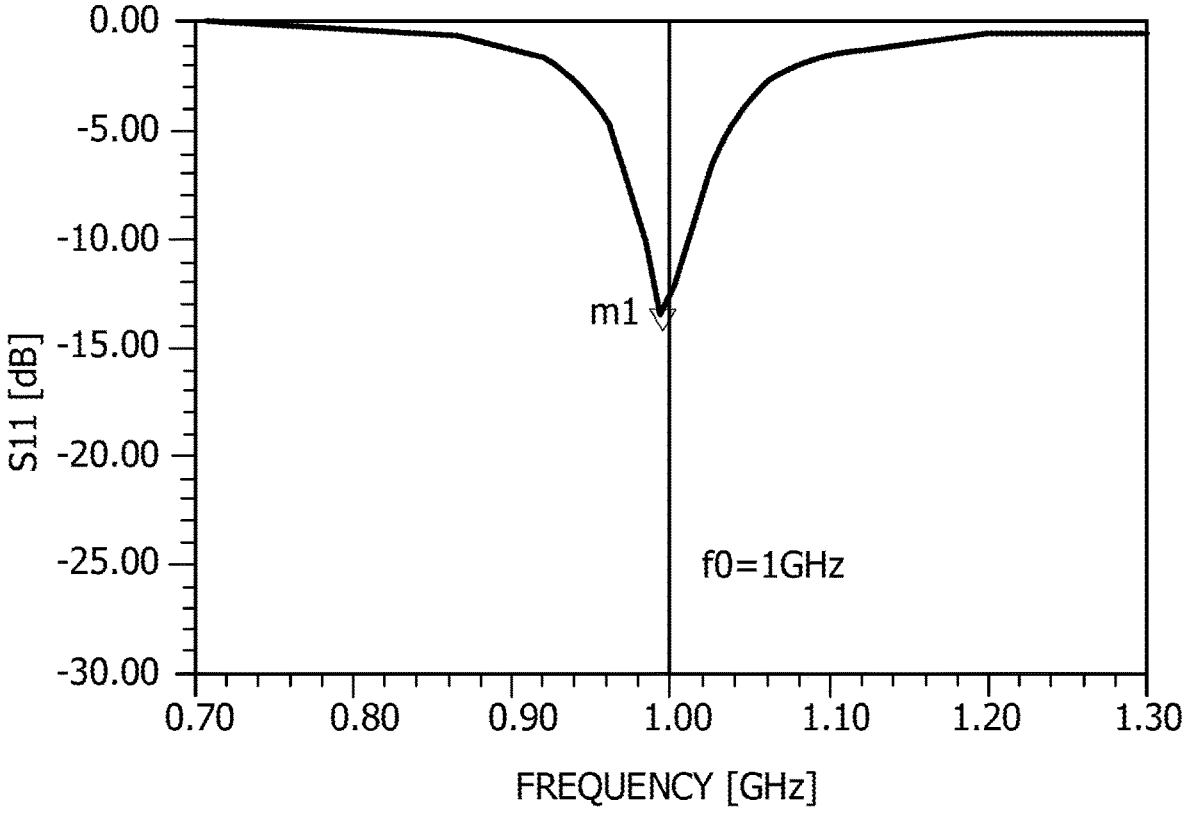
FIG. 12 depicts different reflection characteristics of an antenna apparatus obtained when an external conductor and a dummy conductor are mounted.

FIG. 12 depicts different reflection characteristics of an antenna apparatus obtained when an external conductor and a dummy conductor are mounted. If the dummy conductor 8 is mounted so as to nullify the effect of the external conductor 4 on the antenna characteristics in accordance with curve 15 in FIG. 11, it is possible to adjust the resonance frequency of the antenna element 2 to the designed resonance frequency f0 equal to 1 GHz, as depicted in FIG. 12.

Figure 13A:
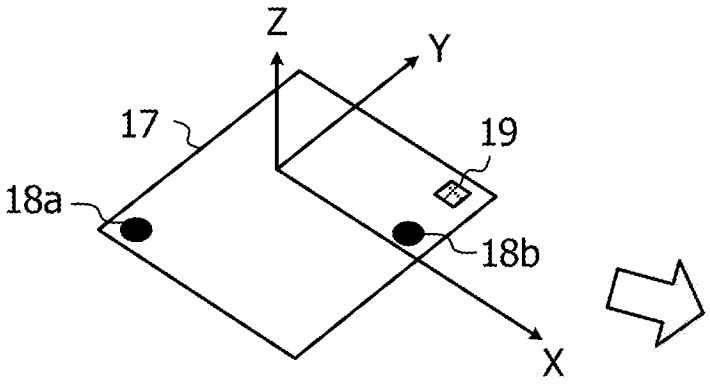
FIGS. 13A-13C depict a way of mounting a dummy conductor on an antenna element.
Figure 13B:
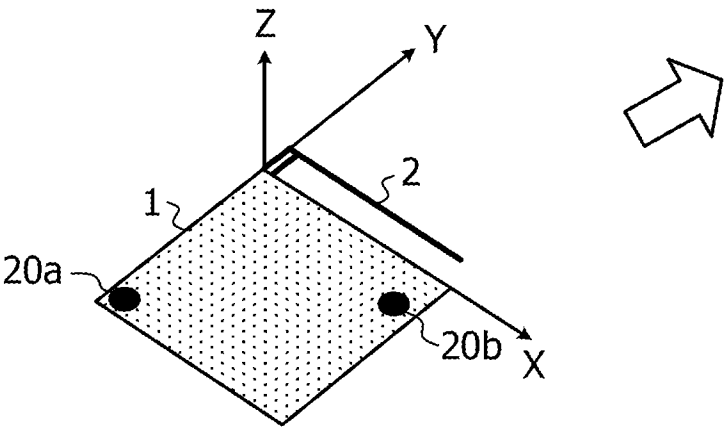
Figure 13C:
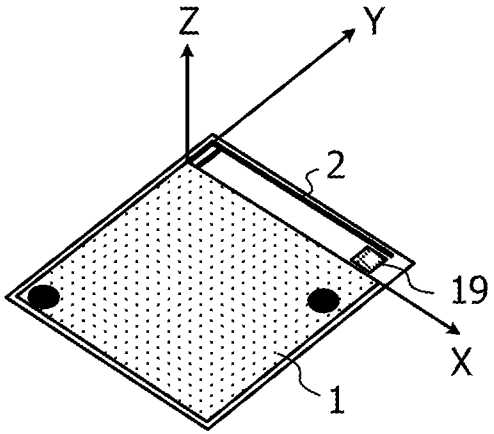

FIGS. 13A-13C depict a way of mounting a dummy conductor on the antenna element 2. FIG. 13A depicts a film for mounting a dummy conductor. FIG. 13B depicts a position where the film is to be placed when the film is attached to a substrate having the antenna element 2. FIG. 13C depicts an arrangement of the antenna apparatus after the dummy conductor is mounted.

In the arrangement depicted in FIG. 13A, a film 17 has markers 18*a* and 18*b* (hereinafter, collectively referred to as markers 18) and a dummy conductor pattern 19. The film 17 is, for example, a plastic film and desirably transparent or translucent, in consideration of the ease of attaching the film 17 to a substrate. Considering the operation of attaching the film 17 to a substrate, the film 17 may be an adhesive film having an adhesive applied in advance to the surface that is to be in contact with the substrate. The markers 18 are marks to be used for positioning the film 17 when the film 17 is attached to the substrate. In this embodiment, each of the markers 18 is circular but may be quadrilateral, star-shaped, or the like. The dummy conductor pattern 19 is, for example, a metal pattern made of a metal such as aluminum or copper deposited onto the film 17. Depositing is a method for forming a thin film. In this method, a vapor produced by heating and vaporizing a metal in a high vacuum is solidified and crystallized on a cooled film surface.

In this embodiment, a case where a dummy conductor is mounted on the open-end side of the antenna element 2 will be described. The positions of the markers 18 and the size of the dummy conductor pattern 19 are determined so that the effect of an external conductor is nullified in accordance with curve 13 in FIG. 8.

The arrangement depicted in FIG. 13B includes the ground conductor 1, the antenna element 2, and markers 20*a* and 20*b* (hereinafter, collectively referred to as markers 20). The same elements in FIG. 13B as in FIG. 1A are denoted by the same reference numerals and are not repeatedly described herein. Similarly to the positions of the markers 18, the positions of the markers 20 are determined so that the effect of an external conductor is nullified in accordance with curve 13 in FIG. 8.

FIG. 13C depicts an arrangement in which the film 17 is attached in a manner such that the positions of the markers 18 of the film 17 coincide with the positions of the markers 20 of the ground conductor 1. In this way, a dummy conductor may be mounted to nullify the effect of an external conductor by attaching the film 17 in the manner such that the positions of the markers 18 and the positions of the markers 20 coincide with each other as depicted in FIG. 13C. Thus, even if an antenna apparatus purchased from an outside supplier does not perform as specified due to the effect of an external conductor, attaching a film that may be positioned by using markers makes it possible to mount a dummy conductor to nullify the effect of the external conductor.

Figure 14:
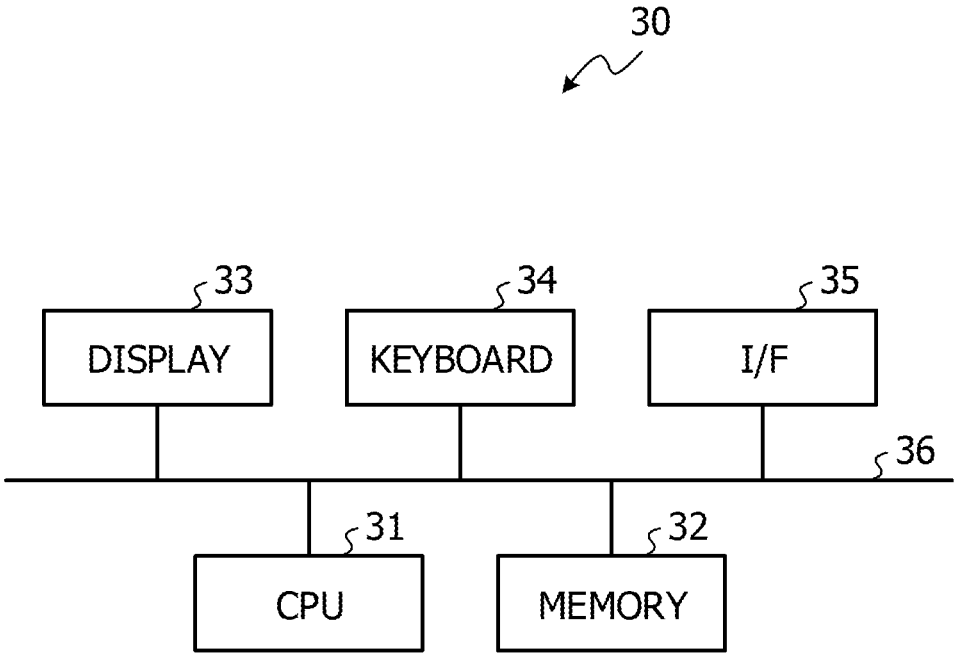
FIG. 14 is a diagram depicting a hardware configuration of an antenna designing apparatus.

FIG. 14 is a diagram depicting a hardware configuration of an antenna designing apparatus. An antenna designing apparatus 30 runs a design program for an antenna apparatus for calculating antenna characteristics of an antenna apparatus. The antenna designing apparatus 30 may be a general-purpose personal computer. The antenna designing apparatus 30 includes a display 33, a keyboard 34, an interface (I/F) 35, a central processing unit (CPU) 31, a memory 32, and a bus 36. The display 33 is a display unit for displaying, for example, an operation screen of a three-dimensional CAD application for producing a model for analysis. The keyboard 34 is an input unit for a user to operate the antenna designing apparatus 30 from outside. The I/F 35 is an external connection unit for connecting the antenna designing apparatus 30 to an external apparatus. The CPU 31 is a calculation unit that reads and executes the design program for an antenna apparatus stored in the memory 32 to realize antenna design processing. The memory 32 is a storage unit for storing, for example, the design program for an antenna apparatus and data generated by the CPU 31 executing programs. The memory 32 may be a non-volatile memory such as a flash memory or a volatile memory such as a random access memory (RAM). The memory 32 may temporarily store programs executed by the CPU 31. A storage apparatus other than the memory 32, such as a hard disk drive (HDD), may be used as a storage unit. The display 33, the keyboard 34, the I/F 35, the CPU 31, and the memory 32 are electrically connected to each other via the bus 36.

Figure 15:
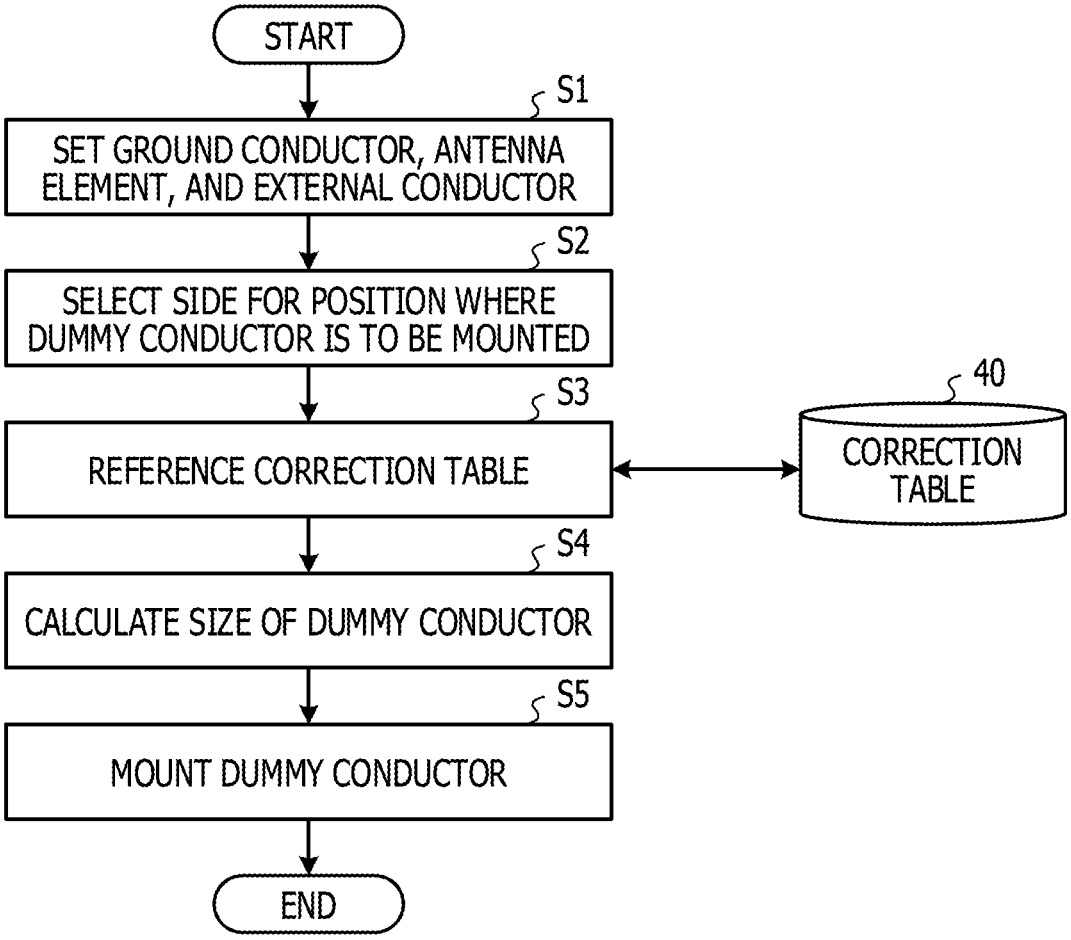
FIG. 15 is a processing flow of a design program for an antenna apparatus.

FIG. 15 is a processing flow of the design program for an antenna apparatus. Each step in the processing flow is realized by the antenna designing apparatus 30, in which the CPU 31 executes the design program for an antenna apparatus stored in the memory 32.

The antenna designing apparatus 30 sets the ground conductor 1, the antenna element 2, and the external conductor 3 or 4 as requested by a user (step S1). The antenna designing apparatus 30 calculates the distance between the antenna element 2 and the external conductor 3 or 4 in accordance with the determined positions of the antenna element 2 and the external conductor 3 or 4. The antenna designing apparatus 30 selects the feed-point side or the open-end side of the antenna element 2 for the position where the dummy conductor 7 or 8 is to be mounted in accordance with the determined position of the external conductor 3 or 4 (step S2). The antenna designing apparatus 30 references a correction table 40 in accordance with the distance between the antenna element 2 and the external conductor 3 or 4, the distance being determined by reading the determined position of the external conductor 3 or 4, and the selected side on which the dummy conductor 7 or 8 is to be mounted (step S3).

The antenna designing apparatus 30 calculates the distance between the antenna element 2 and the dummy conductor 7 or 8, that is, the size of the dummy conductor 7 or 8, to nullify the effect of the external conductor 3 or 4 on the antenna characteristics in accordance with the correction table 40, which has been referenced (step S4). The antenna designing apparatus 30 mounts the dummy conductor 7 or 8 of the calculated size on the selected side of the antenna element 2 (step S5).

As described above, the antenna designing apparatus 30 is capable of setting conditions for mounting a dummy conductor in accordance with the determined positions of a ground conductor, an antenna element, and an external conductor so that the antenna characteristics become the designed characteristics.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An antenna apparatus comprising:

a ground conductor located in a plane;

an antenna element including an antenna that is parallel to the ground conductor and that has a first end portion and a second end portion, a feed line that is coupled to the first end portion of the antenna and that feeds the antenna through the ground conductor, and a short-circuit line that is coupled to the first end portion of the antenna and that electrically short-circuits the antenna to the ground conductor; and a dummy conductor located in the plane between the first end portion or the second end portion of the antenna and the ground conductor, wherein, the ground conductor on a side of the first end-portion of the antenna is mounted at a first distance from an external conductor having a face whose normal is parallel to or nearly parallel to a line parallel to the antenna, and the dummy conductor is mounted at a second distance from the ground conductor between the second end portion of the antenna and the ground conductor, wherein the second distance is based on an amount of shift in a resonance frequency of the antenna element due to placement of the external conductor and an amount of shift in the resonance frequency of the antenna element due to placement of the dummy conductor.

2. The antenna apparatus according to claim 1, wherein a position of a Z-axis direction of the ground conductor with respect to the plane and a position of a Z-axis direction of the dummy conductor with respect to the plane are same.

3. The antenna apparatus according to claim 1,
wherein the dummy conductor is square and the center of gravity of the dummy conductor is located on a line equidistant from the antenna and from the ground conductor.

4. The antenna apparatus according to claim 1,
a size of the dummy conductor is determined according to a wavelength of a resonance frequency of the external conductor and a distance between the external conductor and the antenna element.

* * * * *